United States Patent [19]

Baggett

[11] Patent Number: 4,897,900

[45] Date of Patent: Feb. 6, 1990

[54] HOLDER FOR POCKET SQUARE

[76] Inventor: Rex A. Baggett, 3924 E. Yucca St., Phoenix, Ariz. 85028

[21] Appl. No.: 348,875

[22] Filed: May 8, 1989

[51] Int. Cl.[4] ..... A44B 21/00

[52] U.S. Cl. ..... 24/543; 24/3 H

[58] Field of Search ..... 24/543, 544, 545, 3 R, 24/3 H, 3 J, 3 L, 3 F

[56] References Cited

U.S. PATENT DOCUMENTS

| | | | |
|---|---|---|---|
| 1,631,398 | 6/1927 | Campbell | 24/3 H |
| 2,060,729 | 11/1936 | Gilgenbach | 24/3 H |
| 2,379,092 | 6/1945 | Maschoff | 24/3 H |
| 2,490,405 | 12/1949 | Bloom et al. | 24/543 |
| 2,533,539 | 12/1950 | Vivian | 24/30.5 R |
| 3,184,759 | 5/1965 | Masters | 24/3 R |
| 3,551,965 | 1/1971 | Gordon | 24/543 |
| 3,823,443 | 7/1974 | Takabayashi | 24/543 |
| 3,824,654 | 7/1974 | Takabayashi | 24/543 |
| 3,978,555 | 9/1976 | Weisenthal | 24/543 |
| 4,551,888 | 11/1985 | Beecher | 24/543 |

*Primary Examiner*—Victor N. Sakran

*Attorney, Agent, or Firm*—H. Gordon Shields

[57] ABSTRACT

Holder for a pocket square includes two panels joined together by a living hinge for receiving a pocket square between them. Outer edges of the panels, remote from the living hinge, include fastening elements for securing the panels together with the pocket square disposed between them for maintaining the pocket square in a desired orientation. The apparatus, with the pocket square extending upwardly from the panels, is then placed in a user's breast pocket. The pocket square may be oriented so that as to have any desired amount of the pocket square extending upwardly above the apparatus and above the top of the pocket, and below the apparatus, as necessary. Ribs of various configurations may be disposed on the facing portions of the panels to maintain the pocket square in the desired orientation.

20 Claims, 1 Drawing Sheet

HOLDER FOR POCKET SQUARE

BACKGROUND OF THE INVENTION

1. Field of the Invention

This invention relates to pocket squares and, more particularly, to a holder for a pocket square or pocket handkerchief for display.

2. Description of the Prior Art

U.S. Pat. No. 1,466,993 (Creech, Jr.) discloses a pocket handkerchief holder which is essentially a small pocket for receiving a pocket handkerchief or pocket square. The small pocket is in turn insertable into a user's vest coat pocket. The small insertable pocket includes holder elements for suspending the small pocket at a desired location within the user's coat.

U.S. Pat. No. 1,578,807 (Crossman) discloses a holder for a pocketbook and a key ring. The apparatus comprises a mechanical clip with a loop that fits over a pocket. The key ring is on one side, the outside of the clip, and the pocketbook fits into the user's pocket and is secured to the loop on the inside of the pocket.

U.S. Pat. No. 1,631,398 (Campbell) discloses a display handkerchief supported on a base element. The base element comprises a rectangular element, made of cardboard or the like, with a pair of horizontally extending slits in it. The handkerchief extends through the slits, and accordingly is supported by the base member.

U.S. Pat. No. 1,665,074 (Shepard) discloses a combination advertising element and handkerchief holder. The apparatus comprises a rectangular card folded at the bottom, with the handkerchief appropriately secured to the top, or open, end of the card. In the alternative to having the handkerchief stitched or sewn to the open ends of the card, an alternate embodiment allows for the replacement of the handkerchief as required.

U.S. Pat. No. 1,742,606 (Lichter) discloses a combination advertising element and handkerchief holder. The apparatus comprises a cardboard blank having appropriate slots or slits through which a handkerchief is inserted. The blank is then appropriately folded over the handkerchief, and the folded blank is in turn folded to display the handkerchief outside of the pocket. The folded blank extends down into the user's pocket with the handkerchief extending up above or out of the pocket.

U.S. Pat. No. 2,060,729 (Gilgenbach) discloses a handkerchief holder which also utilizes advertising space on the holder. The holder includes a holding element and a stiffening element to hold a handkerchief, or pieces of cloth, outside of a pocket. The apparatus, itself, comprises a generally "U" shaped element, fastened at the bottom and the sides. The handkerchief is inserted into the element, and a stiffening element is disposed inside the folded handkerchief.

U.S. Pat. No. 2,176,791 (Cronn) discloses a combination billfold and handkerchief simulation holding element. The apparatus is designed to fit into a coat breast pocket. The apparatus includes a billfold which includes a relatively shallow pocket for holding a folded pocket square. The billfold also includes a slot adjacent to the short pocket through which the folded pocket square extends.

U.S. Pat. No. 2,495,012 (Kugler) discloses a pocket handkerchief holder made simply of folded wire elements. The folded wire elements include an elongated loop through which a pocket handkerchief extends and wire elements extending downwardly from the loop for supporting the handkerchief. A second embodiment simply shows a flat element having a tab or flange extending outwardly from the top of the element, and a relatively large aperture or loop in the flange. The pocket square or handkerchief extends upwardly through the loop.

U.S. Pat. No. 2,508,535 (Peters) disclose another element for supporting a pocket square. The apparatus comprises a generally "U" shaped element, with a folded pocket square secured to the upper portion of the U-shaped element. The U-shaped element is preferably cardboard appropriately folded, with plastic elements stapled to the cardboard element to stimulate a cloth pocket square or handkerchief.

U.S. Pat. No. 2,597,146 (Ginal, Jr.) discloses another holder apparatus for a pocket handkerchief. The apparatus comprises a pair of basic support elements, with a handkerchief disposed between them. The base elements are in turn secured together by wire elements. An additional wire element extends downwardly to adjust the height that the pocket square extends out of the user's pocket. The apparatus also includes a case, and the handkerchief, support elements, and wire elements, are disposed within the case. The downwardly extending wire element which is adjustable to vary the height at which the handkerchief extends out of the pocket is secured in any of a plurality of notches.

U.S. Pat. No. 3,135,030 (Weber) discloses a handkerchief retainer element which comprises a case having a hinge along one side and a clasp along the other side. The top of the case is open, and a pocket square is disposed within the case and extends out of the case. The two walls of the case include a plurality of indentations for securely holding the handkerchief. The indentations are aligned, with one being concave and the mating one being convex, on opposite walls of the case.

U.S. Pat. No. 3,184,759 (Masters) discloses another handkerchief holder case. The apparatus comprises a generally U-shaped element with a folded handkerchief disposed between the portions of the U-shaped element. The apparatus also includes snaps for securing the two elements together, and pins which extends through a user's coat to hold the apparatus at the proper or desired height in the user's pocket.

U.S. Pat. No. 4,417,370 (Lewis) discloses a clip for holding a handkerchief in a pocket. The clip utilizes spring jaws, and the handkerchief is disposed between the jaws. The jaws are in turn secured to a lint pad which is disposed in the user's pocket. The handkerchief extends above the pocket, and above the jaws. The lint pad, of course, has utilities separate and apart from its function as part of the handkerchief holder.

SUMMARY OF THE INVENTION

The invention described and claimed herein comprises a pair of holding elements secured together by an integral or living hinge between them, and a clasp at the edges of the elements remote from the living hinge, and the top and bottom portions of the element are open. A folded pocket square or handkerchief is disposed between the panels and extends upwardly above and downwardly below the panels. The panels are secured together by the clasp to hold the folded pocket square or handkerchief. The combination is then inserted into a user's pocket. Alternating horizontally extending ribs may extend transversely across both panels to increase the friction or holding power on the pockets or handkerchief.

Among the objects of the present invention are the following:

To provide new and useful apparatus for holding a pocket square;

To provide new and useful holding apparatus including a pair of panels secured together at the sides of the panels and open at the top and bottom of the panels;

To provide new and useful pocket square apparatus having a pair of panels secured together by a living hinge; and To provide new and useful holder apparatus for holding a pocket square and comprising a pair of panels having transversely extending ribs for securing a pocket square between the panels.

DESCRIPTION OF THE PREFERRED EMBODIMENT

Figure 1:
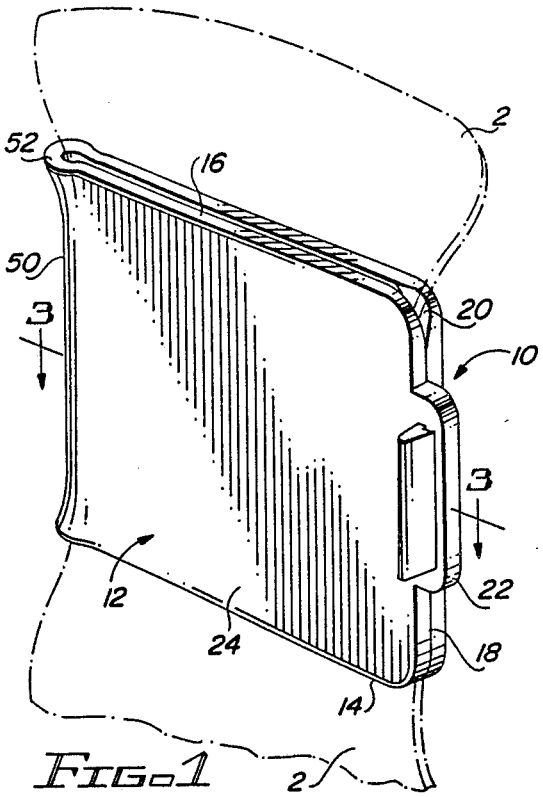
FIG. 1 is a perspective view of the apparatus of the present invention.

FIG. 1 is a perspective view of pocket square holder apparatus 10 of the present invention. The pocket square holder apparatus 10 includes a pair of panels, a panel 12 and a panel 30. The panels 12 and 30 are shown secured together in FIG. 1. A pocket square 2 is shown in FIG. 1 in phantom, with a portion extending upwardly and a portion extending downwardly or outwardly from the holder apparatus 10.

Figure 2:
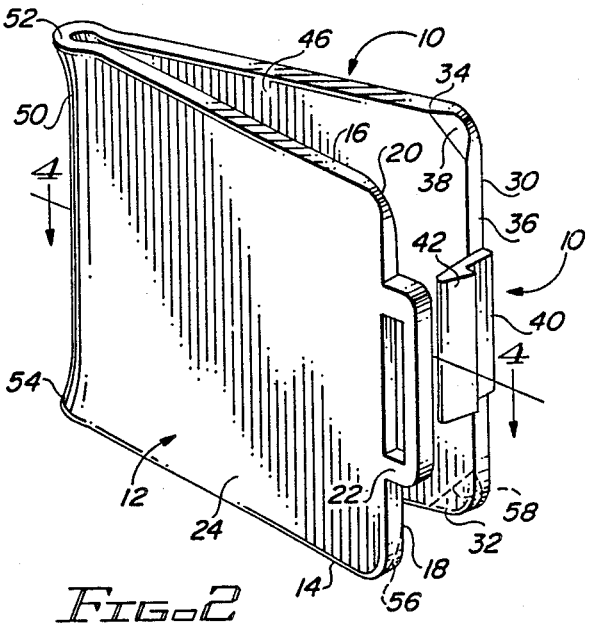
FIG. 2 is a perspective view of the apparatus of FIG. 1, with portions of the apparatus slightly separated.
Figure 3:
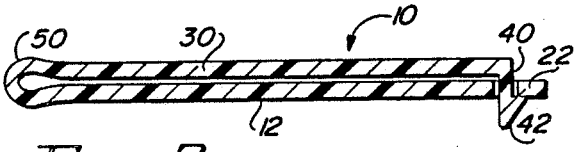
FIG. 3 is a view in partial section taken generally along line 3—3 of FIG. 1.
Figure 4:
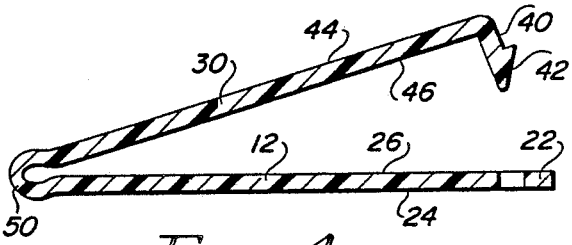
FIG. 4 is a view in partial section taken generally along line 4—4 of FIG. 2.

FIG. 2 is a perspective view of the pocket square holder apparatus 10 of FIG. 1, with the panels 12 and 30 spaced apart, or pivoted slightly open. FIG. 3 is a view in partial section taken generally along line 3—3 of FIG. 1. FIG. 4 is a view in partial section taken generally along line 4—4 of FIG. 2. For the following discussion of apparatus 10, reference will primarily be made to FIGS. 1, 2, 3, and 4.

The panel 12 is generally of a rectangular configuration, with a bottom edge or end 14, a top edge or end 16, an outer or open edge or end 18, and with a locking loop 22 extending outwardly from the edge or end 18. In addition, there is a relieved portion 20 at the inner side or juncture of the edges 16 and 18, as will be discussed in detail below.

The panel 12 includes two faces, an outer face 24 and an inner 26. It is an upper corner of the inner face 26 which includes the relieved portion 20 at the juncture of the edges 16 and 18.

The outer face 24 is generally planar, or relatively smooth and flat, so as to not present any impairment or impediment to the removal and insertion of the apparatus 10 in the breast coat pocket of a user. Similarly, the inner face 26 is also relatively smooth or planar for convenience in adjusting a handkerchief or pocket square, as will be discussed below.

The panel 30 includes a bottom edge or end 32, a top edge or end 34, and an outer or open edge or end 36. The panel 30 is of substantially the same size and configuration as the panel 12. The edges 32, 34, and 36 are aligned parallel, and adjacent to, the edges 14, 16, and 18, respectively, when the apparatus 10 is closed, as shown in FIGS. 1, and 3.

A clasp 40 is secured to the outer edge 36 of the panel 30. The clasp 40 includes a locking tab 42. The clasp 40 extends through the locking loop 22, and the locking tab 42 secures the panels 12 and 30 together.

At the juncture of the edges 34 and 36, and on the inner portion of the panel 30, there is a relieved portion 38 which is aligned with the relieved portion 20 of the panel 12 when the apparatus 10 is in the closed positions as shown in FIGS. 2 and 4.

The panel 30 includes two faces, an outer face 44 and an inner face 46. The relieved portion 38 extends inwardly from the inner face 46 at the juncture of the edges 34 and 36.

Both faces 44 and 46 are generally smooth or planar, substantially identical to the faces 24 and 26 of the panel 12.

The panels 12 and 30 are secured together by a living hinge 50. The hinge 50 may extend substantially the full height or length of the panels 12 and 30. At the upper edge or portion of the hinge 50, there is a flared portion 52. The flared portion 52 extends outwardly, or away from the panels 12 and 30. There may also be a flared portion 54 at the bottom of the hinge 50, as shown in phantom in FIG. 2. In addition, there may also be relieved portions at the inner bottom corner of the panels 12 and 14, adjacent to the junctures of the edges 13, 18 and 32, 36, as indicated in phantom by reference numerals 56 and 58 in FIG. 2, as desired.

The purpose of the flared top 52 and of the relieved portions 20 and 38 is to allow a handkerchief or pocket square to be flared outwardly or to be fluffed, if you will. This is illustrated in FIG. 1 in dotted line. The widening or arranging or fluffing of the pocket square or handkerchief 2 may be accomplished either before or after the holder apparatus 10, with the square or handkerchief disposed therein, is inserted into the user's pocket. In many cases, it may be desirable to arrange or orient the pocket square or handkerchief in a particular manner after it has been disposed in the user's pocket.

The bottom flared portion 54 and the relieved portions 56 and 58 are for convenience in orienting and moving the handkerchief or pocket square 2 relative to the apparatus 10.

It will be noted that both the top and bottom of the apparatus 10 is open. That is, there is no rim at the bottom or top of the apparatus 10 to prevent a pocket square from extending freely below the holder apparatus 10. Moreover, once the holder apparatus 10 and pocket square or handkerchief is in place in the user's pocket, the vertical height of the pocket square may be adjusted upwardly, as desired. On the other hand, if the height is too great, the holder apparatus 10 may easily be removed from the pocket and the pocket square handkerchief may be pulled downwardly from the bottom of the holder apparatus 10 without the necessity of opening the apparatus, or separating the panels 12 and 30 and completely rearranging or relocating the pocket square or handkerchief within the holder apparatus 10.

Figure 5:
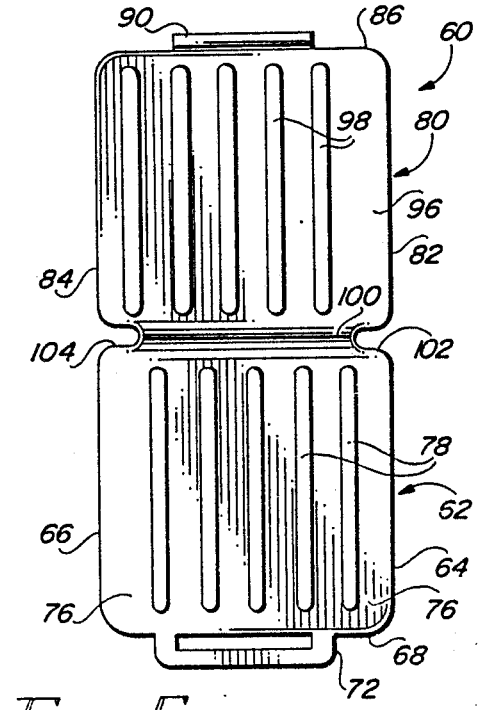
FIG. 5 is a top plan view of an alternate embodiment of the apparatus of the present invention.
Figure 6:
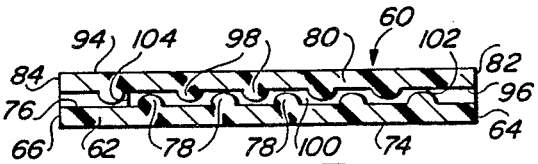
FIG. 6 is a view in partial section of a portion of the apparatus of FIG. 5 in a closed position.

FIG. 5 is a plan view of an alternate embodiment of pocket square or handkerchief holder apparatus 60 of the present invention. The holder apparatus 60 is quite similar to the apparatus 10 of FIGS. 1–4, except for the inclusion of ribs to increase the friction on the pocket square or handkerchief secured to the apparatus 60 and a variation in the hinge portion. FIG. 6 is a view in partial section of the holder apparatus 60 of FIG. 5 in its closed position. For the following discussion, reference will primarily be directed to FIGS. 5 and 6.

The pocket square or handkerchief holder apparatus 60 includes two panels, a panel 62 and a panel 80. The panels 62 and 80 are both preferably generally in a rectangular configuration. The panel 62 includes a bottom edge or end 64, a top edge or end 66, and an outer or open edge or end 68. Extending outwardly from the outer edge 68 is a locking loop 72. The locking loop 72 cooperates with a mating locking clasp and tab to secure the panels 62 and 80 together.

The panel 62 includes two faces, an outer face 74 and an inner face 76. The outer face 74 is generally planar or flat, substantially identical to the outer face 24 of the panel 12 of the holder apparatus 10.

The panel 80 includes a bottom edge or end 82, a top edge or end 84, and an outer or open edge or end 86. A clasp 90 extends outwardly from the edge 86, generally perpendicular thereto and to the plane of the panel 80 to mate with the locking loop 72. The clasp 90 includes a locking tab 92 which extends through the loop 72 and locks or secures the panels 62 and 80 together, substantially as illustrated in FIGS. 1 and 3 for the holder apparatus 10.

The panel 80 includes two faces, an outer face 94 and an inner face 96. The outer face 94 is relatively smooth or planar, as discussed above for the outer face 74 and for the outer faces 24 and 44 of the holder apparatus 10. The clasp 90 extends generally perpendicular to the plane of the face 94.

The panel 80 also includes an inner face 96. The face 96 is disposed in a generally parallel arrangement or orientation to the inner face 76 of the panel 62 when the apparatus 60 is closed, as shown in FIG. 6.

On the face 76, there is a plurality of transversely extending ribs 78. The ribs 78 extend outwardly relatively smoothly and are of a generally uniform roundness. The ribs 78 are generally transversely oriented with respect to the vertical orientation of the apparatus 60 in a user's pocket. That is, they extend from side to side, as opposed to vertically.

On the inner face 96 of the panel 80 there is also a plurality of transversely extending ribs 98. The ribs 98 are substantially identical to the ribs 78. The ribs 98 differ only from the ribs 78 in that the ribs 98 are on the opposite panel 80 from the panel 62 and its ribs 78, and the ribs 98 are in an alternating orientation or relationship with the ribs 78. This is best shown in FIG. 6. Thus, when the panels 62 and 80 are folded, or are closed, in their use orientation, the ribs 78 and 98 are staggered or alternated to provide greater locking ability or holding power to a pocket square or handkerchief disposed in the holder 60, as compared to the smooth inner faces 26 and 46 discussed above, and as shown in FIGS. 1–4, for the holder apparatus 10.

The ribs 78 and 90 comprise friction enhancing elements for enhancing the frictional engagement between the central portion of the pocket square or handkerchief disposed between the panels 62 and 80.

The panels 62 and 80 are appropriately secured together by a living hinge 100. The hinge 100 is substantially identical to the hinge 50 of the holder apparatus 10 except that it terminates a predetermined distance above and below the bottom edges 64, 82 and 66, 84, respectively.

Below the hinge 100 is a slot 102, and above the hinge 100 is a slot 104. The slots 102 and 104 extend from the hinge 100 to the bottom edges 64, 96 and 66, 84, respectively. The slots 102 and 104 provide generally the same function as the flared portion 52 (and 54, if desired) for the holder apparatus 10. The slot 104 allows the top of the pocket square or handkerchief to be adjusted outwardly, if desired, from the holder apparatus 60.

If desired, relieved corners on the edges of the panels 62 and 80, as the relieved corners 20, 38 (and 56, 58) may be provided.

The utilization of the ribs 78 and 98 provides a built-in friction enhancing system to help securely hold a handkerchief or pocket square within the holder apparatus 60. However, it will be noted that the holder apparatus 60 is also open at both the top and the bottom so that a pocket square may be oriented at any particular location with respect to the holder apparatus 60. Once oriented, the employment of the ribs 78 and 98 increases the degree of difficulty of raising or lowering the pocket square or handkerchief without releasing the clasp 90 and locking tab 92 from the locking loop 72 to release the pressure on the pocket square handkerchief disposed within the apparatus 60.

Figure 7:
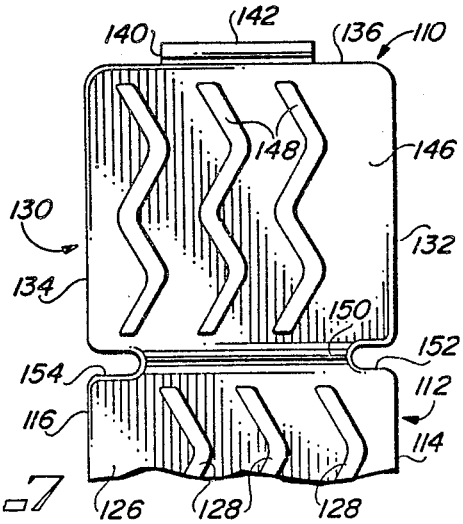
FIG. 7 is a plan view of a portion of an alternate embodiment of the apparatus of FIG. 5.

Another alternate embodiment of the apparatus of the present invention is illustrated in FIG. 7. FIG. 7 comprises a plan view of a portion of an alternate pocket square or handkerchief holder apparatus 110 of the present invention. The pocket square holder apparatus 110 includes a pair of panels 112 and 130, which are substantially identical in general configuration to the holder apparatus 60 and to the holder apparatus 10, as discussed above. The holder apparatus 110 includes a panel 112 and a panel 130, both of which include bottom, top, and outer edges, and a living or integral hinge. The panels are also secured together by a locking loop and clasp and locking tab arrangement, as generally discussed above for the holder apparatus 10 in the holder apparatus 60.

The holder apparatus 110 includes a panel 112 with a bottom edge or end 114 and a top end or edge 116. The panel 112 also includes an inner face 126, with a plurality of ribs 128 disposed on the inner face 126.

The panel 130 includes a bottom edge or end 132, a top edge or end 134, and an outer edge or end 136. A clasp 140, with a locking tab 142, extends outwardly from the outer end 136. The clasp 140 and the locking tab 142 are substantially identical to the corresponding elements discussed above for the holder apparatus 10 and the holder apparatus 60.

The panel 130 also includes an inner face 146, with a plurality of ribs 148 disposed on the inner face 146. The ribs 146, like the ribs 128, are of a curved configuration, or a short and wide "W" configuration, as opposed to the relatively straight, horizontal ribs 78 and 98 of the holder apparatus 60. The ribs 128 and 148 are staggered with respect to each other so that when the panels 112 and 130 are disposed in a parallel alignment, or closed, as when the apparatus 110 is closed, the ribs 128 and 148 alternate or interleave, similar to the interleaving or staggering or alternating of the ribs 78 and 98 of holder apparatus 60, as may best be understood from FIG. 6.

The inner faces 126 and 146 may include relieved portions at the juncture of the sides or edges, substantially similar to the relieved corners at the inner faces for the apparatus 10. Or, in the alternative, the inner face corners may be smooth end planar, as with the inner faces 76 and 98 of the holder apparatus 60 of FIG. 5.

The panels 112 and 130 are secured together by a living hinge 150. The living hinge 150 is shorter than the overall length of the panels 126 and 146, leaving a slot 152 at the bottom of the hinge 150 between the panels 112 and 130, and a slot 154 above the hinge and between the panels. The slots 152 and 154 compare or correspond to the slots 102 and 104 of the holder apparatus 60 and perform substantially the same function. The slots, and the relatively open outer ends of the panels, above and below the clasp 140 (and its companion loop, not shown) allow the pocket square or handkerchief to flare outwardly, as desired.

The ribs 128 and 148 provide the additional friction for a pocket square handkerchief disposed within the apparatus 110, and between the panels 112 and 130, as discussed above for the ribs 78 and 98 of the apparatus 60.

It will be noted that, again, the holder apparatus 110 is open at both the bottom and the top so that a pocket square or handkerchief may be oriented and adjusted vertically in an appropriate manner. The friction on a pocket square or handkerchief disposed within the holder apparatus 110 by the ribs 128 and 148 is such that generally the holder apparatus 110 should be opened to relieve the pressure or friction on the pocket square handkerchief in order to arrange or rearrange the vertical location of the pocket square handkerchief in the holder apparatus 110.

For a pocket square of a limited size, and thus with minimum folds, the ribbed holder apparatus 60 or 110 may be preferable to the holder apparatus 10, with its relatively smooth inside faces. However, for a relatively bulky handkerchief, when used as a pocket square, the necessity for ribbed inner faces for additional friction or holding power may not be necessary. Accordingly, the apparatus 10 may be satisfactory. Moreover, the employment of smooth inner faces renders the vertical movement of the pocket square or handkerchief with respect to the holder apparatus a relatively simple procedure. However, with the employment of ribbed inner faces, and particularly with a respectively thick pocket square or handkerchief, comprising several different layers of cloth, the holder apparatus may need to be taken apart, or opened, in order to rearrange the vertical orientation of the element disposed within the apparatus.

The employment of the relieved portions, the flared portions on the hinge, and the slots above and below the hinges, allows a pocket square or handkerchief to be spread, or widened or fluffed, as shown in FIG. 1 as desired, after the pocket square or handkerchief has been disposed within the holder apparatus. The top flared portion, slot, and relieved portions allow the spreading to be accomplished after the holder and the pocket have been disposed in the user's pocket.

It will also be noted that the pocket square holder apparatus, with a pocket square disposed within the holder, may be turned upside down to display either the top portion or the bottom portion of a pocket square. That is, with one portion of a pocket square or handkerchief extending upwardly from or out of the top opening of the holder, and with a second portion extending downwardly from or out of the bottom opening of the holder, and with only the central or middle portion disposed within the holder, essentially either the first or second portions may be displayed by simply inverting the apparatus. Height and spreading adjustments may be made to whichever portion is to be displayed. For all practical purposes, the terms "top" and "bottom" are interchangeable, depending on what portion of an enclosed pocket square or handkerchief is to be displayed. This feature is particularly advantageous for multicolor and multi-design pocket squares and handkerchiefs.

A pocket square or handkerchief may be folded to display the corners or the central portion, as desired. The holder apparatus of the present invention allows a user to fold and to display whatever portion is desired and in virtually whatever manner is desired. By having the corners extending upwardly and the center portion downwardly, both may be displayed alternately by merely inverting the holder. Vertical adjustments and spreading, etc., if required, may easily be accomplished.

It is obvious that a full pocket square or handkerchief may be used for multiple matching of wardrobes.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Pocket square holder apparatus for holding a pocket square, comprising, in combination:

panel means for holding a pocket square, including first panel means, including a first panel having a first side, a second side, a top edge and a bottom edge, for holding a pocket square, second panel means, including a second panel having a first side, a second side, a top edge, and a bottom edge, for cooperating with the first panel of the first panel means for holding a pocket square between them, hinge means for securing the first and second panels together, including a hinge secured to the first sides of the first and second panels, relieved portions at the junctures of the top edges and the second sides of the first and second panels for spreading the pocket square, and means for locking the first and second panels together at their second sides;

a stop opening between the top edges of the first and second panels through which a first portion of the pocket square extends; and a bottom opening between the bottom edges of the first and second panels through which a second portion of the pocket square extends.

2. The apparatus of claim 1 in which the first and second panel means include second relieved portions at the junctures of the bottom edges and the second sides for spreading the second portion of the pocket square.

3. The apparatus of claim 1 in which the first and second panels include smooth inner faces.

4. The apparatus of claim 1 in which the first and second panels include ribbed inner faces.

5. The apparatus of claim 4 in which the ribbed inner faces are interleaved.

6. The apparatus of claim 1 in which the first panel includes an inner face.

7. The apparatus of claim 6 in which the inner face of the first panel is smooth.

8. The apparatus of claim 7 in which the inner face includes a plurality of ribs spaced apart from each other.

9. The apparatus of claim 8 in which the second panel includes an inner face.

10. The apparatus of claim 9 in which the inner face of the second panel includes a plurality of ribs spaced apart from each other.

11. The apparatus of claim 10 in which the plurality of ribs on the inner face of the first panel are interleaved with the plurality of ribs on the inner face of the second panel.

12. The apparatus of claim 1 in which the panel means includes means for enhancing the frictional engagement between the pocket square and the first and second panels.

13. The apparatus of claim 12 in which the means for enhancing the frictional engagement includes a plurality of ribs contacting the pocket square.

14. The apparatus of claim 1 in which the panel means includes a first slot above the hinge means through which part of the first portion of the pocket square extends.

15. The apparatus of claim 14 in which the panel means includes a second slot below the hinge means through which part of the second portion of the pocket square extends.

16. Pocket square holder apparatus for holding a pocket square, comprising, in combination:

panel means for holding a pocket square, including first panel means, including a first panel having a first side, a second side, a top edge and a bottom edge, for holding a pocket square, and second panel means, including a second panel having a first side, a second side, a top edge, and a bottom edge, for cooperating with the first panel of the first panel means for holding a pocket square between them;

a top opening between the top edges of the fist and second panels through which a first portion of the pocket square extends;

a bottom opening between the bottom edges of the first and second panels through which a second portion of the pocket square extends;

hinge means for securing the first and second panels together, including a hinge secured to the first sides of the first and second panels and a first flared portion adjacent to the top edges of the first sides of the first and second panels for spreading the first portion of the pocket square; and means for locking the first and second panels together at their second sides.

17. The apparatus of claim 16 in which the hinge means includes a second flared portion adjacent to the bottom edges and the first sides of the first and second panels for spreading the second portion of the pocket square.

18. The apparatus of claim 16 in which the first and second panels include smooth inner faces.

19. The apparatus of claim 16 in which the first and second panels include inner faces, and the inner faces include a plurality of ribs spaced apart from each other.

20. The apparatus of claim 16 in which the panel means includes means for enhancing frictional engagement between the pocket square and the first and second panels.

* * * * *